US006142602A

United States Patent [19]

Tanaka

[11] Patent Number: 6,142,602

[45] Date of Patent: Nov. 7, 2000

[54] INK CARTRIDGE AND INK JET RECORDING APPARATUS

[75] Inventor: Katsunori Tanaka, Tokyo, Japan

[73] Assignee: NEC Corporation, Tokyo, Japan

[21] Appl. No.: 09/048,586

[22] Filed: Mar. 27, 1998

[30] Foreign Application Priority Data

Mar. 27, 1997 [JP] Japan ..... 9-076313

[51] Int. Cl.[7] ..... B41J 2/165

[52] U.S. Cl. ..... 347/29; 347/33; 347/86

[58] Field of Search ..... 347/86, 87, 44, 347/29, 108, 33

[56] References Cited

U.S. PATENT DOCUMENTS

| | | | |
|---|---|---|---|
| 4,646,111 | 2/1987 | Shimosato et al. | 400/124 X |
| 5,289,213 | 2/1994 | Murai et al. | 347/29 |
| 5,363,132 | 11/1994 | Ikkatai | 347/29 X |
| 5,440,331 | 8/1995 | Grange | 347/33 X |
| 5,572,245 | 11/1996 | Cowger | 347/44 |
| 5,682,186 | 10/1997 | Bohorquez et al. | 347/29 |
| 5,883,648 | 3/1999 | Hetzer | 347/33 |

FOREIGN PATENT DOCUMENTS

| | | |
|---|---|---|
| 418828 | 3/1991 | European Pat. Off. . |
| 495491 | 7/1992 | European Pat. Off. . |
| 0 671 273 A1 | 9/1995 | European Pat. Off. . |
| 61-242848 | 10/1986 | Japan . |
| 61-255862 | 11/1986 | Japan . |
| 62-101445 | 5/1987 | Japan . |
| 63-274552 | 11/1988 | Japan . |
| 1-291947 | 11/1989 | Japan . |
| 2-045156 | 2/1990 | Japan . |
| 8-39827 | 2/1996 | Japan . |

*Primary Examiner*—William J. Royer
*Attorney, Agent, or Firm*—Foley & Lardner

[57] ABSTRACT

An ink cartridge has a cover that is in intimate contact with an ink tank around the ink injection port and having an opening portion at a position corresponding to the ink injection port, and the protection cap held slidably between the cover and the ink tank for opening/closing the opening portion. When the protection cap is closed, the ink injection port is tightly closed. Also, the protection cap of the ink cartridge has a lever projecting from the opening portion of the cover. An ink cartridge holder fixed to the recording apparatus for loading the ink cartridge thereon has claws engaged with a lever of the ink cartridge in the loading condition. When the ink cartridge is loaded, the protection cap is opened by the claws.

15 Claims, 6 Drawing Sheets

INK CARTRIDGE AND INK JET RECORDING APPARATUS

BACKGROUND OF THE INVENTION

1. Field of the Invention

The present invention relates to an ink cartridge and an ink jet recording apparatus. In particular, the present invention relates to an ink cartridge in which an ink injection port is prevented from drying by a protection cap, and an ink jet recording apparatus provided with this ink cartridge.

2. Description of the Related Art

Several kinds of conventional ink cartridges are used in an ink jet type recording apparatus in order to obtain a stable recording image that always has a high quality, while preventing the ink in the ink injection port from drying or evaporating without non-uniformity in the image caused by the failure of the ink injection.

In general, if the ink injection port is exposed for a long time, the drying is started in a few minutes so that a fault such as a nozzle clogging condition would occur. For this reason, the non-uniformity in the image caused by a dot skip would occur in printing. It is therefore necessary to prevent the dry air around the ink injection port from coming into direct contact with the nozzle when the ink injection port is not used.

For example, Japanese Patent Application Laid-open No. Hei 8-39827 describes a technology for covering the ink injection port by a cap member that is detachable as desired in order to protect the ink injection port.

However, in the above-described piece of prior art, since the protection cap is of a detachable type, there is a problem that the protection cap may become lost.

Also, it is troublesome to remove the protection cap upon the installation on the recording apparatus.

SUMMARY OF THE INVENTION

An object of the present invention is to provide an ink cartridge in which there is no fear that the projection cap for the ink injection port would be lost.

Also, another object of the present invention is to prevent the degradation in printing quality caused by the drying of the ink injection port.

Also, another object of the present invention is to dispense with a job for removing the protection cap upon the installation on the recording apparatus.

To achieve the above-mentioned objects, an ink cartridge according to the present invention is brought into intimate contact with an ink tank around an ink injection port, and has a cover having an opening portion in a position corresponding to the ink injection port and a protection cap held slidably between the cover and the ink tank for opening/closing the opening portion. When the protection cap is closed, the ink injection port is tightly closed.

Accordingly, the protection cap for the ink injection port is formed into one piece together with the ink cartridge and is structured to slidably open/close. When it closes, the ink injection port is prevented from drying.

Also, in an ink jet recording apparatus in which the ink cartridge is to be loaded, there is provided a protection cap retainer that is to be engaged with the protection cap of the ink cartridge in the loaded condition. When the ink cartridge is to be loaded, the protection cap is opened by the protection cap retainer, and when the ink cartridge is to be removed, the protection cap is closed by the protection cap retainer.

When the ink cartridge is loaded in the ink jet recording apparatus, the protection cap retainer is engaged with the protection cap. As the ink cartridge is pushed deeply, the protection cap is opened. When it is fully loaded, the protection cap is opened without fail. When the ink cartridge is unloaded, the protection cap retainer is engaged with the protection cap. As the ink cartridge is drawn out, the projection cap is closed. When it is completely removed, the protection cap is closed without fail.

Accordingly, the protection cap is automatically opened upon loading, and the projection cap is automatically closed upon unloading.

Also, the ink jet recording apparatus has the protection cap retainer that is to engage with the protection cap for the ink cartridge, a spring for pushing the protection cap retainer in a direction in which the protection cap is closed, a motor for holding the protection cap retainer in a direction in which the protection cap is opened or in a direction in which it is closed, or keeping free the movement of the protection cap retainer, and a controlling section for recognizing the reception of printing data and the printing processing condition to thereby control the motor.

The ink jet recording apparatus controls to recognize the reception of the printing data and the printing processing condition for moving the protection cap in the opening direction or in the closing direction and holding it in place. As a result, the protection cap is closed in a condition such as a stand-by condition. Also, by providing the spring for pushing the protection cap retainer in the direction in which the protection cap is closed, the protection cap is closed by the spring when a power source is turned off and the movement of the protection cap is kept free. Thus, even not only in a condition that the ink cartridge is reserved but also in a stand-by condition that it is loaded in the ink jet recording apparatus but printing is not carried out or in the condition that the power source is turned off, or the like, the drying of the ink is prevented and the degradation in printing quality is prevented.

BRIEF DESCRIPTION OF THE DRAWINGS

The above-mentioned objects and advantages of the invention will become more apparent from the following detailed description when read in conjunction with the accompanying drawings, with like reference numerals indicating corresponding parts throughout, and wherein.

DETAILED DESCRIPTION OF THE PREFERRED EMBODIMENTS

Next, embodiments of an ink cartridge according to the present invention will now be described in more detail with reference to the drawings.

Figure 1:
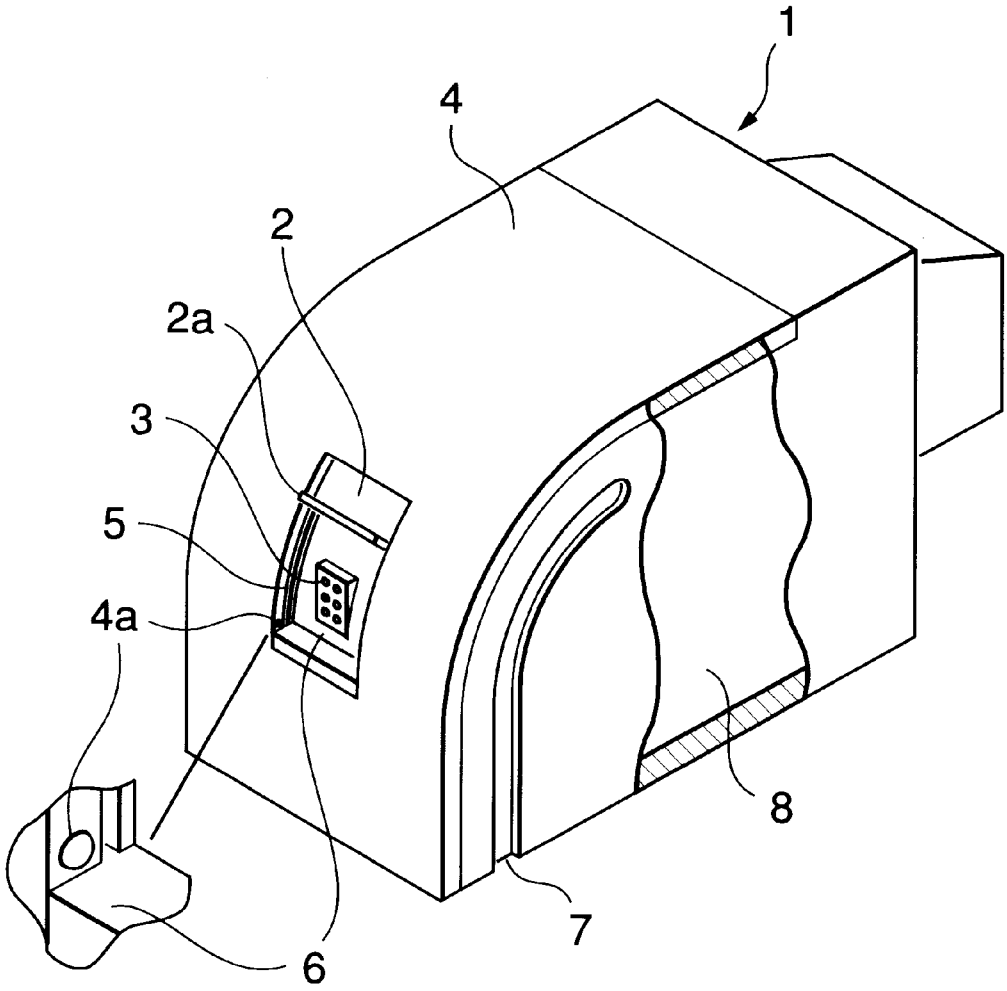
FIG. 1 is a perspective view showing an ink cartridge according to a first embodiment of the present invention.

FIG. 1 is a perspective view showing an ink cartridge according to a first embodiment of the present invention.

An ink cartridge 1 is composed of an ink injection port 3, a protection cap 2 that is slidably opened and closed, a cover 4 for slidably holding the protection cap 2, and an ink tank 8 provided internally with ink.

The ink injection port 3 is preferably made of a metal plate having a plurality of holes (nozzles) for injecting the ink.

The protection cap 2 is preferably made of plastic and is a cylindrical plate member held slidably between the ink tank 8 and the cover 4.

Also, a lever 2*a* is formed at an end portion of the protection cap 2. The lever 2*a* is a parallelepiped projecting outwardly with respect to the outer periphery of the cover 4, and the operation of the lever 2*a* to slide the protection cap 2 causes the projection cap 2 to open/close.

The cover 4 is a plate-like member (substantially non-flexible) preferably made of plastic. It is brought into intimate contact with the ink tank 8 around the ink injection port 3 and has an opening portion at a position corresponding to the ink injection port 3. The cover 4 is fixed to the ink tank 8 through the protection cap 2 in the vicinity of the ink injection port 3 while slidably holding the protection cap 2.

The protection cap 2 is slid along the inner surface of the cover 4 of the ink cartridge 1. The lever 2*a* of the protection cap 2 is brought into contact with the end portion of the opening of the cover 4, so that the protection cap 2 is stopped in a closed position. When the projection cap 2 is opened, the ink injection port 3 is exposed externally so that the ink may be jetted. When the protection cap 2 is closed, the ink injection port 3 is covered by the protection cap 2, and an air-tight condition is acquired so that drying of the ink does not occur to the extent that it would if the protection cap 2 is opened.

The detailed structure of the vicinity of the protection cap 2 will now be described.

FIG. 2 is a cross-sectional view showing a condition that the protection cap 2 is closed in the ink cartridge shown in FIG. 1.

The ink tank 8 has such a shape that a recess is formed corresponding to the protection cap 2 in the portion thereof on which the projection cap 2 is mounted.

Also, the cover 4 has a shape in conformity with the contour of the ink tank 8 and is mounted in intimate contact with the ink tank 8. A gap having a substantially constant width is formed between the inner surface of the cover 4 and the ink tank 8. The protection cap 2 is held slidably in a gap 5 formed between the cover 4 and the ink tank 8.

Also, a rubber piece 6 for keeping air-tightness is provided at a portion of the cover 4 with which the lever 2*a* of the protection cap 2 is brought into contact with when the protection cap 2 is slid to cover the ink injection port 3 and to close the opening portion of the cover 4. The rubber piece 6 has a parallelepiped shape so that the rubber piece 6 is in contact with the lever 2*a* of the protection cap 2 when the protection cap 2 is closed. Also, a sharp portion or protrusion 2b preferably having a height of about 0.5 mm is provided at an outer portion of the lever 2*a*. When the protection cap 2 is closed, the protrusion 2*b* enters the rubber piece 6 to thereby ensure the air-tight property.

Figure 2A:
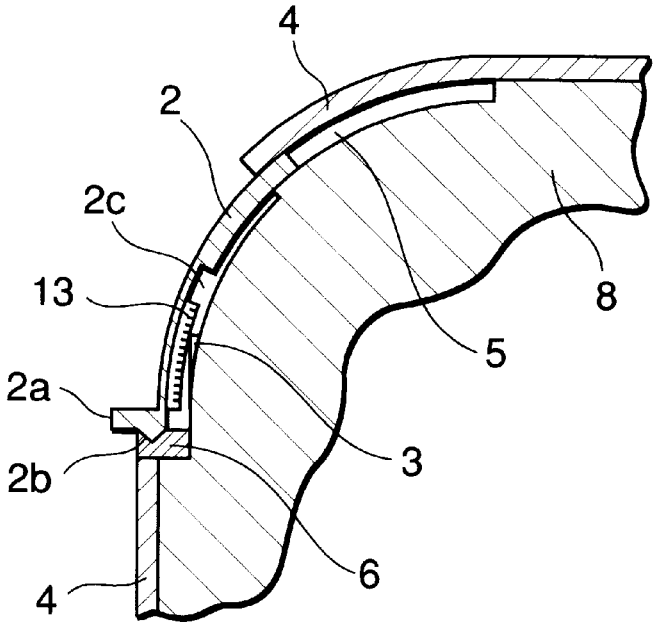
FIG. 2A is a partial cross-sectional view in the vicinity of the protection cap under the condition that the protection cap is closed in the ink cartridge shown in FIG. 1.
Figure 2B:
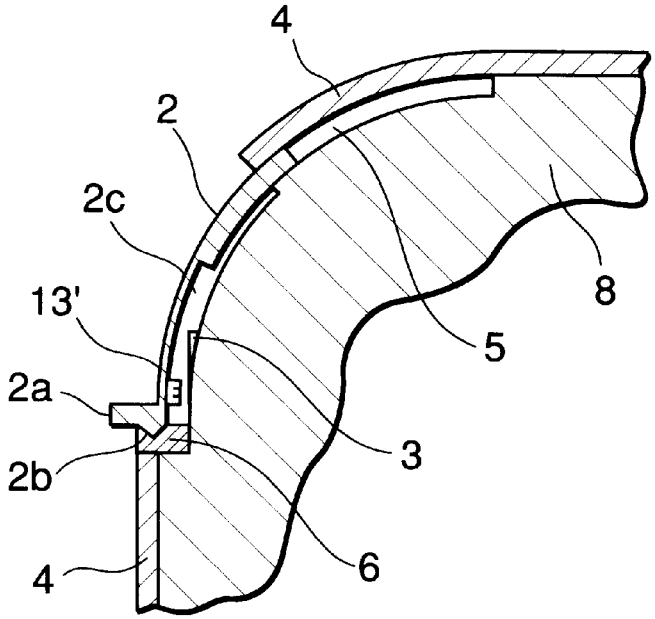
FIG. 2B is a partial cross-sectional view in the vicinity of the protection cap under the condition that the protection cap is closed in the ink cartridge shown in FIG. 1, in an alternative configuration.

Furthermore, a groove 2*c* is provided on the back side of the protection cap 2 so that the protection cap 2 and the ink injection port 3 are not brought into contact with each other. A brush 13 that is preferably made of sponge material is provided in the groove 2*c*. The brush 13 has such functions that, when the protection cap 2 is opened from a closed state, the ink injection port 3 is cleaned and at the same time, the drying of the ink injection port 3 may also be prevented under the condition when the protection cap 2 is closed. FIG. 2A shows the brush 13 is contact with the ink injection port 3 when the protection cap 2 is fully closed, and FIG. 2B shows an alternative configuration in which a brush 13' is positioned separate from the ink injection port when the protection cap 2 is fully closed.

Also, recess portions (not shown) are provided at both ends of the protection cap 2 in the vicinity of the lever 2*a* thereof. As shown in FIG. 1, circular projections 4*a* preferably having a diameter of about 0.5 mm are provided on both sides inside and in the vicinity of the rubber piece 6 in the opening portion of the cover 4. When the protection cap 2 is closed and the sharp portion 2*b* enters the rubber piece 6, the recess portion of the protection cap 2 and the projections 4*a* of the cover 4 are engaged with each other. As a result, the protection cap 2 is locked in the closed condition.

With the arrangement described above, the air-tightness within the protection cap 2 is well kept, and since the protection cap 2 is fixed in order not to be opened accidentally when the protection cap 2 is closed, it is possible to prevent the drying of the ink injection port 3 without fail by closing the protection cap 2.

Incidentally, the mechanism for locking the protection cap 2 in the closed condition is not limited to the recess portions of the above-described lever 2*a* and the projections 4*a* of the cover 4. Any other mechanism may be used to ensure that the protection cap 2 does not accidentally open when the protection cap is closed.

Figure 3:
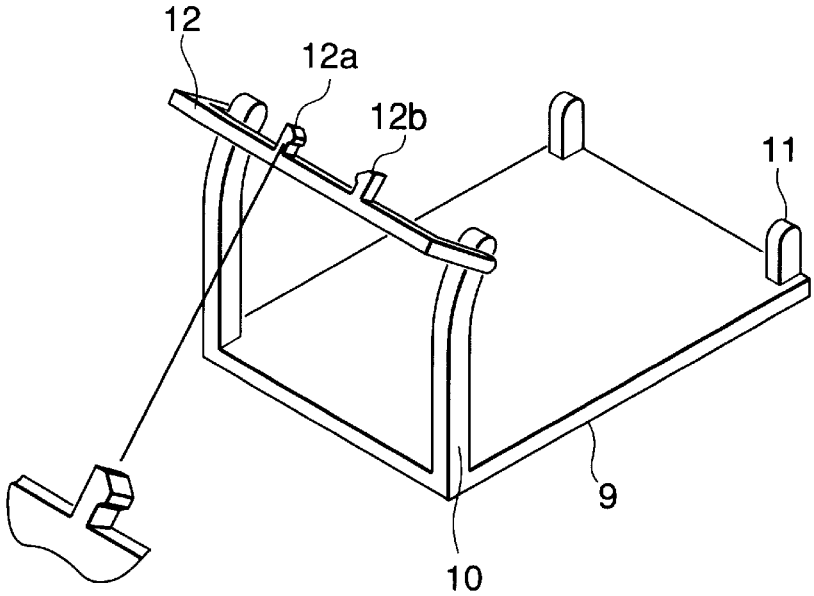
FIG. 3 is a partially enlarged perspective view showing an ink cartridge holder which is an ink cartridge loading portion of the ink jet recording apparatus for printing with the ink cartridge shown in FIG. 1.

FIG. 3 is a partially enlarged perspective view showing an ink cartridge holder 9 that is an ink cartridge loading portion of the ink jet recording apparatus for printing with the ink cartridge 1 shown in FIG. 1 loaded.

The ink cartridge holder 9 is a member for mounting the ink cartridge 1 on the carrier of the printer. The ink cartridge holder 9 has lower arms 10, upper arms 11 and a protection cap retainer 12. The protection cap retainer 12 has a pair of claws 12*a* and 12*b*. These components are all preferably formed of plastic material. The lower arms 10 are formed into a shape for engaging with grooves 7 formed on side walls on both sides of the ink cartridge shown in FIG. 1.

Figure 4:
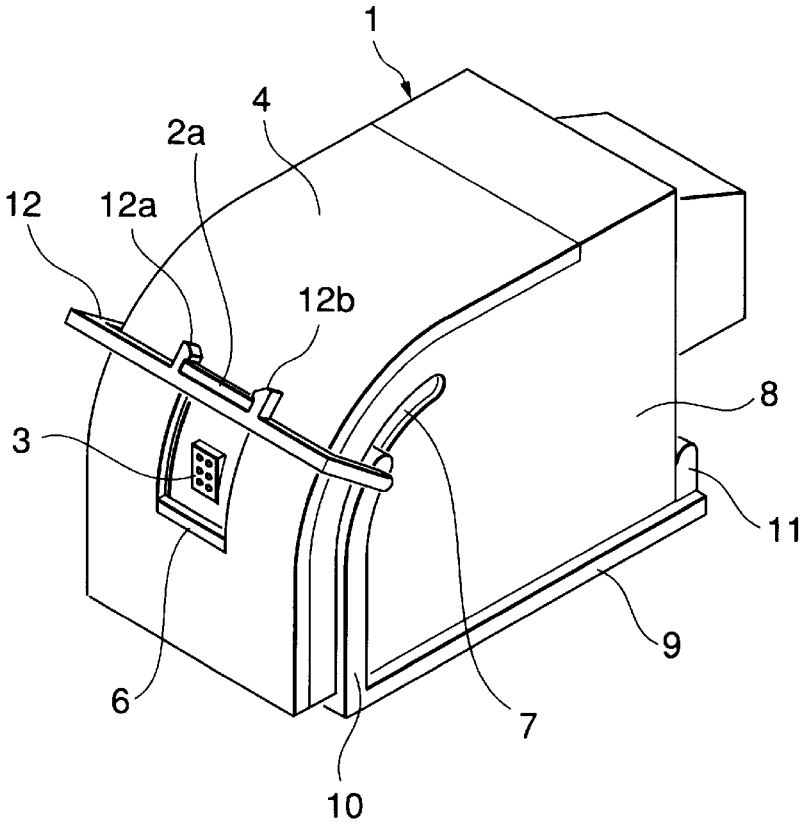
FIG. 4 is a perspective view showing a condition that the ink cartridge shown in FIG. 1 is loaded on the ink cartridge holder shown in FIG. 3.

FIG. 4 is a perspective view showing a condition that the ink cartridge 1 according to the present invention is loaded on the ink cartridge holder 9 shown in FIG. 3.

When the ink cartridge 1 is loaded on the ink cartridge holder 9, the ink cartridge 1 is adapted to be inserted into the ink cartridge holder 9 from above in the drawing so that the lower arms 10 of the ink cartridge holder 9 are fitted in the grooves 7 of the ink cartridge 1. Then, the ink cartridge 1 is clamped by the lower arms 10 and the upper arms 11 for fixture. Upon unloading, the claws 12*a* and 12*b* of the protection cap retainer 12 are engaged with both end portions of the lever 2*a* of the protection cap 2 shown in FIG. 1 so that the protection cap 2 is automatically pushingly opened.

Also, when the ink cartridge 1 is removed from the ink cartridge holder 9, since the claws 12*a* and 12*b* of the protection cap retainer 12 are displaced along the grooves 7 while being engaged with both end portions of the lever 2*a* of the protection cap 2, the protection cap 2 is automatically closed and locked when it is removed from the ink cartridge holder 9.

Incidentally, the shapes of the lever 2*a* and the claws 12*a* and 12*b* are not limited to those shown in the drawings. Any other shapes may be taken if these components are engaged with each other upon loading of the ink cartridge, and when the ink cartridge is to be removed, the protection cap 2 is closed and locked by the engagement portion.

An ink cartridge according to a second embodiment mode of the present invention will now be described with reference to the drawings.

Figure 5:
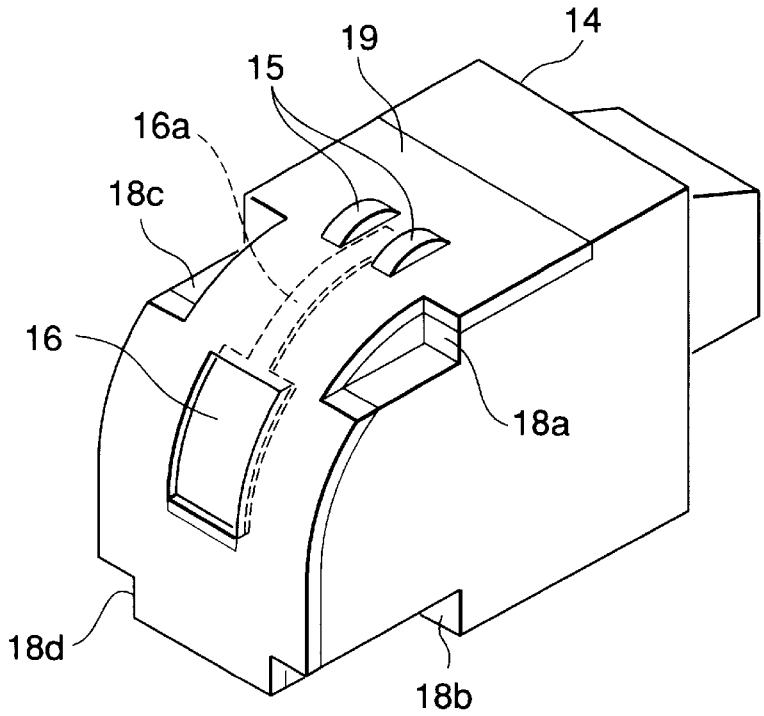
FIG. 5 is a perspective view showing an ink cartridge according to a second embodiment of the present invention.

FIG. 5 is a perspective view showing the ink cartridge according to the second embodiment of the present invention.

Referring to FIG. 5, rollers 15 are provided in a single surface of an ink cartridge 14. These rollers 15 are made of material such as rubber having a large frictional coefficient. Also, in contrast to the first embodiment, there is a difference in that a protection cap 16 has an extension portion 16*a*. The rollers 15 are in contact with the extension portion 16*a* of the protection cap 16. The rotation of the rollers 15 cooperates with the opening/closing of the protection cap 16.

Figure 6:
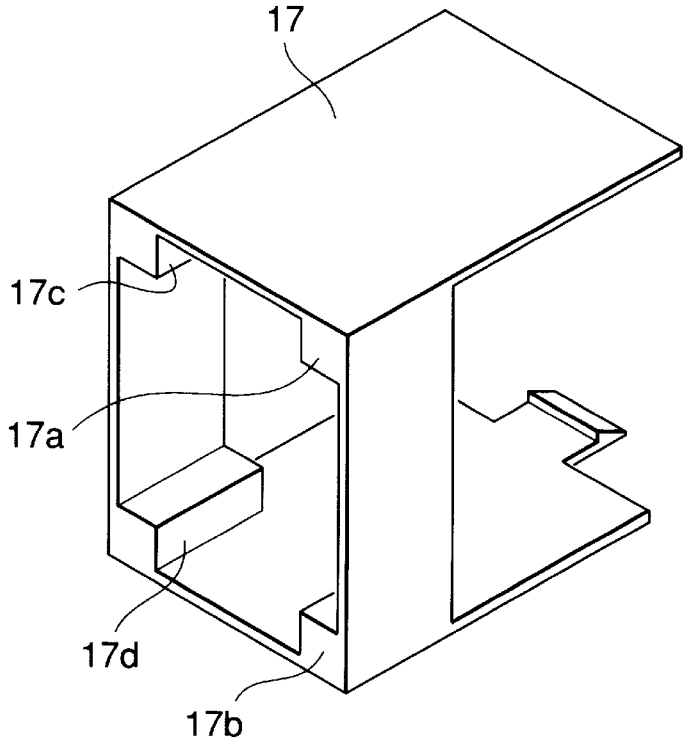
FIG. 6 is a perspective view showing an ink cartridge holder which is an ink cartridge loading portion of the ink jet recording apparatus for printing with the ink cartridge shown in FIG. 5.

FIG. 6 is a perspective view of an ink cartridge holder 17 which is the ink cartridge loading portion of the ink jet recording apparatus for printing with the ink cartridge 14 shown in FIG. 5 loaded. The ink cartridge 14 is loaded by inserting it into the ink cartridge holder 17 from the right in FIG. 6.

In this case, the rollers 15 are rotated by the friction with the inner walls of the ink cartridge holder 17. The protection cap 16 is opened/closed during the attachment/detachment of the ink cartridge 14.

Figure 7:
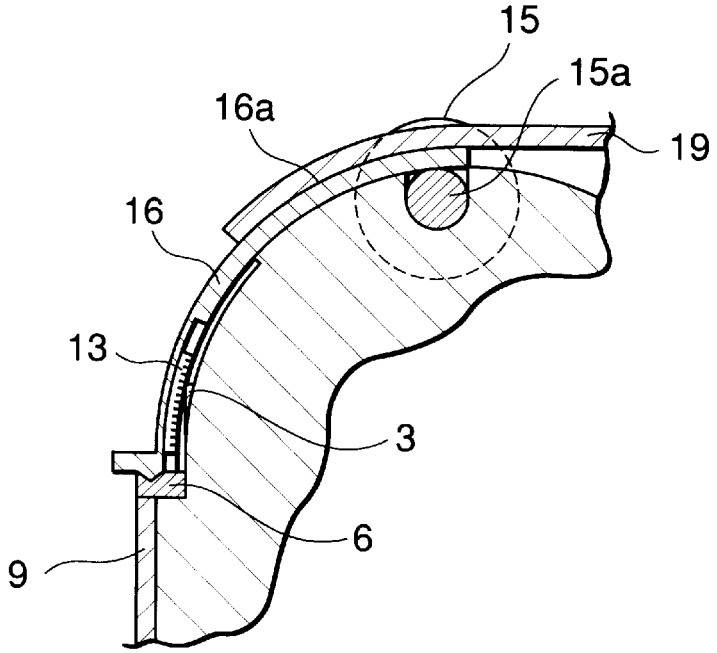
FIG. 7 is a partial cross-sectional view in the vicinity of the protection cap under the condition that the protection cap is closed in the ink cartridge shown in FIG. 5.

FIG. 7 is a partial cross-sectional view, in the vicinity of the protection cap, of the condition that the protection cap 16 is closed in the ink cartridge 14 shown in FIG. 5.

The two rollers 15 shown in FIG. 5 are coupled by a roller shaft 15*a*. As shown in FIG. 7, the roller shaft 15*a* is pressed by a cover 19 and in contact with the extension portion 16*a* of the protection cap 16.

Accordingly, when the ink cartridge 14 is loaded on the ink cartridge holder 17, since the rollers 15 are rotated clockwise in FIG. 7 by the friction with the inner surface of the ink cartridge holder 17, the protection cap 16 is opened. When the ink cartridge 14 is unloaded, since the rollers 15 are rotated in the counterclockwise direction, the protection cap 16 is closed.

Incidentally, any other shape may be taken if the rollers are rotatably held in contact with the extension portion of the protection cap, and the protection cap is slid by the rotation.

Also, a shape of the ink cartridge holder and a position of the rollers may be changed if it is met that upon the loading of the ink cartridge or the unloading thereof, the rollers are rotated and the protection cap is opened or closed.

The ink jet recording apparatus for printing with these ink cartridges may be of a type that the above-described ink jet holder is mounted on a carrier. Furthermore, it is possible to take a structure which has a drive mechanism for moving the projection cap retainer in accordance with the first embodiment or a drive mechanism for rotating the rollers in accordance with the second embodiment so that with the drive mechanism, the protection cap may be opened/closed by a controlling section of the ink jet recording apparatus body.

Still further, the ink jet recording apparatus may be structured so that only in a first case of reception of the printing data or in a second case of printing processing or in a third case where the printing data are not received for a predetermined period of time after the printing processing, the protection cap is moved in a direction in which the protection cap is opened. In the third case, after the predetermined period of time has expired without receiving any printing data, the protection cap is closed. In the conditions other than these modes, the movement of the protection cap is kept free in the stand-by condition and when the power source is turned off, the protection cap is closed. Not only in a condition that the ink cartridge is reserved (e.g., not loaded into a printer) but also in the condition that the cartridge is loaded on the ink jet recording apparatus and is in operation, the drying of the ink is prevented and the degradation in printing quality is prevented.

Figure 8:
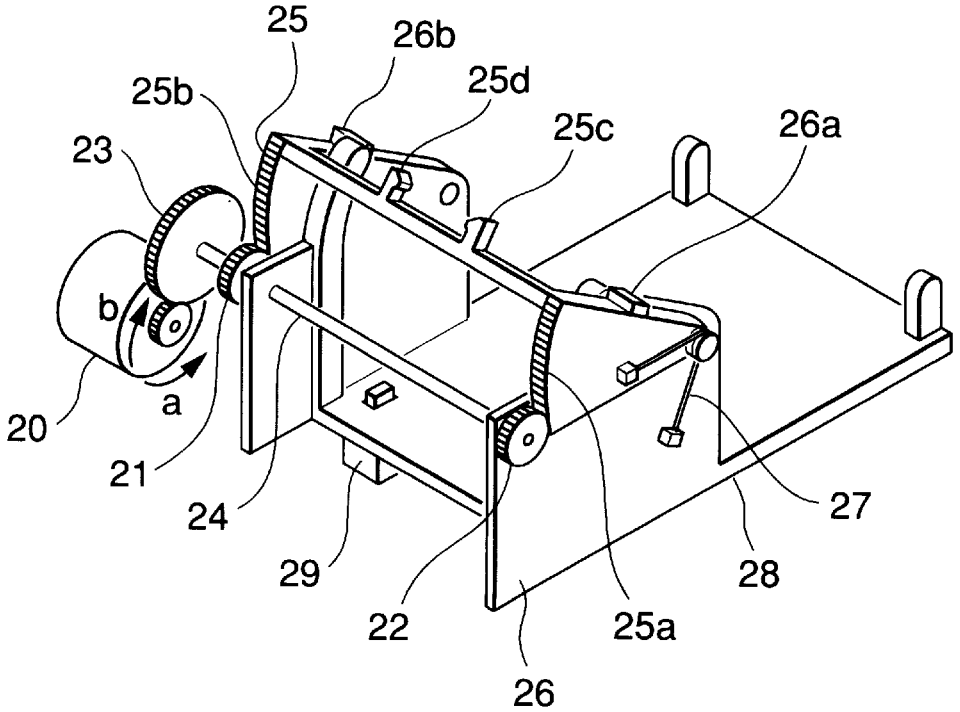
FIG. 8 is a perspective view showing an ink cartridge holder having a drive mechanism for opening/closing the protection cap with the ink cartridge holder shown in FIG. 1.

FIG. 8 is a perspective view of an ink cartridge holder 28 having a drive mechanism for holding the ink cartridge shown in FIG. 1 and opening/closing the protection cap 2.

As shown in FIG. 8, the motor 20 is connected to gear portions 25*a* and 25*b* of the protection retainer 25 through gears 21, 22 and 23 and a shaft 24. During the turning-on of the power source of the ink jet recording apparatus, the protection cap retainer 25 is brought into contact with a stop portion 26*a* of a lower frame 26 so that the protection cap 2 is held in the open condition or otherwise rotated in the opposite direction so that the protection cap retainer 25 is lowered into contact with the lower frame 26 and the protection cap 2 is kept in the closed condition. Also, if the power source is turned off, the rotation is free (e.g., not locked).

Also, it is structured that the spring 27 for pushing the protection cap in the closed condition is attached in between the protection cap retainer 25 and the lower frame 26, and when the power source of the ink jet recording apparatus is turned off and the rotation of the motor is free, the protection cap 2 is closed.

Also, instead of providing the spring 27 on the ink cartridge holder 28 side, an elastic member or the like, such as a coil spring or a plastic molded member, may be interposed in the gap 5 of the ink cartridge 1 shown in FIG. 2 in a direction in which the protection cap 2 is closed, and a force for closing the protection cap 2 is applied on the ink cartridge 1 side.

Further, in the case where the ink cartridge 14 in which the protection cap 16 is opened/closed by the rollers 15 as shown in FIG. 5 is loaded, in the condition that the ink cartridge 14 is loaded, it is in contact with the rollers 15, and the drive rollers to which the rotational torque is applied by the motor may be provided on the ink cartridge holder.

In this case, it is assumed that the rotational torque is applied to the shaft of the drive rollers in the closed direction of the protection cap by a spiral spring, the torsion bar or the like.

Figure 9:
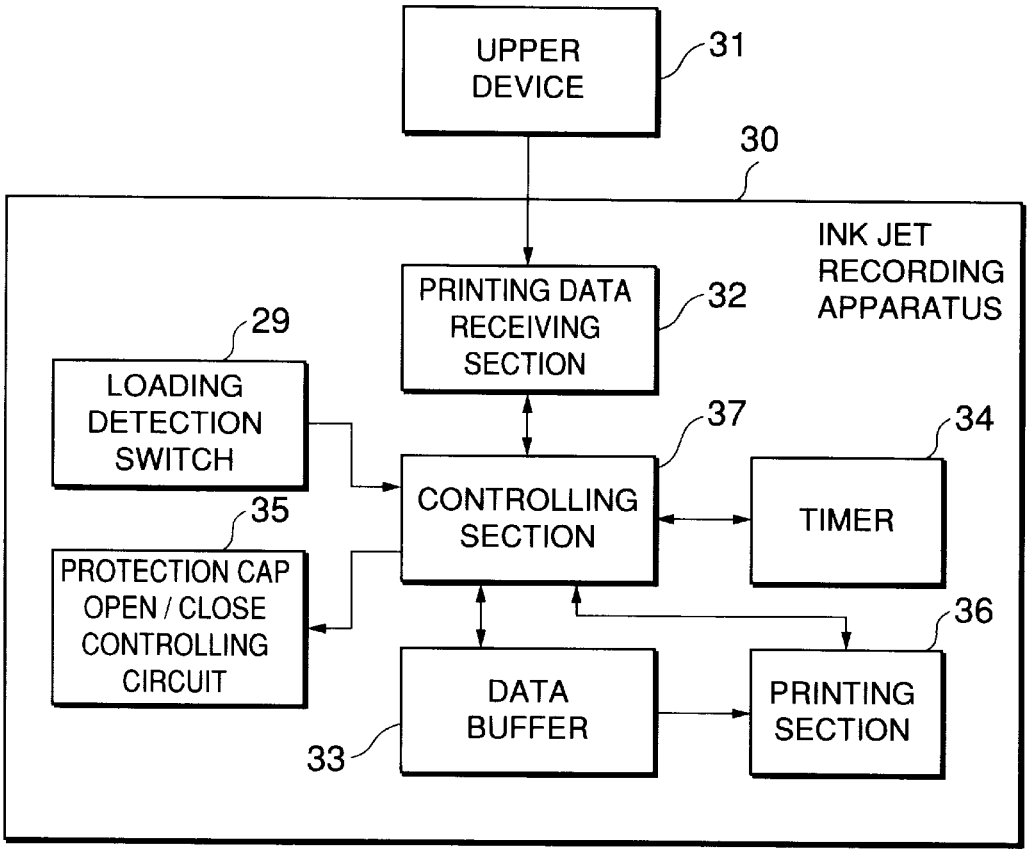
FIG. 9 is a block diagram showing the ink jet recording apparatus for closing the protection cap in the case where the printing has been completed corresponding to the received printing data and the printing data have not been received for a predetermined period of time.

FIG. 9 is a block diagram showing the ink jet recording apparatus for closing the protection cap in the case where the printing has been completed corresponding to the received printing data and the printing data have not been received for a predetermined period of time.

As shown in FIG. 9, the ink jet recording apparatus 30 has a printing data receiver 32 for receiving the printing data from an upper device 31, recognizing that the printing data are received and outputting the printing data detection signal, a data buffer 33 for recognizing the presence of the converted printing data, in which the received data are interpreted (e.g., x-y coordinate transformation of characters and numbers), converted into a data form that may be recognized in the printing section and stored, a timer 34, a protection cap opening/closing controlling circuit 35 for controlling the motor 20 for driving the opening/closing of the protection cap 2, a loading detection switch 29 for detecting whether or not the ink cartridge 1 is loaded, the printing section 36 for performing the printing on the basis of the data stored in the data buffer 33, and the controlling section 37 for controlling these components.

The controlling section 37 controls the printing section 36 so that, if the printing data are stored in the data buffer 33, the protection cap opening/closing controlling circuit 35 is controlled to thereby rotate the motor 20 in a direction b shown in FIG. 8 to open and hold the protection cap 2. On the basis of the printing data that have been stored, the printing operation is performed until no data are present in the data buffer 33. When it is recognized that the no data are present in the data buffer 33, the controlling section 37 detects whether or not the printing data are present in the printing data receiving section 32. In the case where the printing data are present in the printing data receiving section 32, while the protection cap 2 is kept in the open condition, the received data are interpreted and converted into the data form that may be recognized in the printing section, and are stored in the data buffer. The printing operation is carried out. In the case where no printing data are present in either section, the timer 34 is reset to start the time counting. During this period, the protection cap 2 is kept in the open condition. The printing data detection signal is inputted into the controlling section 37 from the printing data receiving section 32 before the lapse of a constant period of time from the start of the timer 34, the controlling section stops the timer 34 and performs the printing operation while holding the protection cap 2 in the open condition. Unless the printing data detection signal is inputted until the lapse of the constant time period, the protection cap opening/closing controlling circuit 35 is controlled to rotate the motor 20 in the direction a shown in FIG. 8, or the rotation of the motor is free and the protection cap 2 is closed. Under this condition, if the printing data detection signal is inputted into the controlling section 37, the protection cap opening/closing controlling circuit 35 is controlled, the motor 20 is rotated in the direction b shown in FIG. 8, the protection cap 2 is opened and held, and the printing operation is carried out.

Also, when the power source of the ink jet recording apparatus is turned off, the motor 20 is free, so that the protection cap 2 is closed by the spring 27 shown in FIG. 8 as described above.

With such an arrangement, when no printing data are received, or in the stand-by condition, or the power source is turned off, the protection cap 2 may be closed.

Also, in the stand-by condition in which no printing data are received, in the case where the attachment/detachment of the ink cartridge is detected by the loading detecting switch, and in the case where the power source is turned on, the opening/closing operation of the protection cap 2 is to be carried out after the ink cartridge loading has been detected. This is because the protection cap 2 is engaged with the claws 25*c* and 25*d* of the protection cap retainer without fail, even if the ink cartridges are replaced when the protection cap 2 is closed.

As described above, with the ink cartridge according to the present invention, since the protection cap for the ink injection port is slid to be opened/closed without detaching the cap from the ink cartridge, there is no fear that the protection cap for the ink injection port may become lost. Also, by the operation of loading the ink cartridge onto the ink cartridge holder according to the present invention to be mounted on the printer, it is possible to obtain the effect that the work of operating the cap when the cartridge is loaded on the printer is dispensed with.

Also, the ink jet recording apparatus for performing the printing operation with the ink cartridge according to the present invention has the drive mechanism for engaging with and opening/closing the protection cap. With such a drive mechanism, the openable/closable structure is ensured. When the ink jet recording apparatus has not received the printing data and has been kept in the stand-by condition for a constant period of time, or otherwise the power source is turned off, the protection cap is closed. Not only in a condition that the ink cartridge is reserved but also in the condition that the cartridge is loaded on the ink jet recording apparatus and is in operation, the drying of the ink is prevented and the degradation in printing quality is prevented.

While preferred embodiments have been described herein, modification of the described embodiments may become apparent to those of ordinary skill in the art, following the teachings of the invention, without departing from the scope of the invention as set forth in the appended claims.

What is claimed is:

1. An ink jet recording apparatus, comprising:

an ink cartridge which comprises:

an ink tank;

an ink injection port mounted on said ink tank for injecting ink;

a cover which is in intimate contact with said ink tank around said ink injection port and has an opening portion at a position corresponding to said ink injection port; and a protection cap held slidably between said cover and said ink tank for opening/closing said opening portion, wherein when said protection cap is closed, said ink injection port is provided with a substantially air-tight closure with respect to air external to said covers;

a holder on which said ink cartridge is loaded;

arms extending from said holder to an opening/closing direction of said protection cap of said ink cartridge to be loaded; and an engagement portion, fixed to said arms, which is engaged with and opens said protection cap of said ink cartridge loaded along said arms.

2. The ink jet recording apparatus according to claim 1, further comprising:

an opening/closing driving means for moving said engagement portion and for opening/closing said protection cap.

3. An ink jet recording apparatus, comprising:

an ink tank;

an ink injection port mounted on said ink tank for injecting ink;

a cover which is in intimate contact with said ink tank around said ink injection port and has an opening portion at a position corresponding to said ink injection port;

a protection cap held slidably between said cover and said ink tank for opening/closing said opening portion, wherein when said protection cap is closed, said ink injection port is provided with a substantially air-tight closure with respect to air external to said cover; and rollers held rotatably in contact with said protection cap and sliding said protection cap by rotation.

4. An ink jet recording apparatus, comprising:

an ink cartridge which comprises an ink tank, an ink injection port mounted on said ink tank for injecting ink, a cover which is in intimate contact with said ink tank around said ink injection port and has an opening portion at a position corresponding to said ink injection port, a protection cap held slidably between said cover and said ink tank for opening/closing said opening portion, wherein when said protection cap is closed, said ink injection port is provided with a substantially air-tight closure with respect to air external to said cover;

an engagement portion that is engaged with said protection cap of said ink cartridge;

an elastic member for pushing said engagement portion in a direction in which said protection cap is closed;

an opening/closing driving means for moving said engagement portion in a direction in which said protection cap is opened, or in the direction in which said protection cap is closed, or for keeping said engagement portion free; and a controlling means for recognizing the reception of printing data and the printing processing condition and for controlling said opening/closing driving means.

5. The ink jet recording apparatus according to claim 4, wherein said controlling means controls the opening/closing driving means, so that said engagement portion is moved in a direction in which said protection cap is opened in a printing data reception state, or a printing processing state, or in a state where no printing data are received for a predetermined period of time after the printing processing state, and wherein movement of said engagement portion is kept free in modes other than these states.

6. The ink jet recording apparatus according to claim 5, further comprising a timer for counting up to the predetermined period of time, and for outputting a signal to close the protection cap when the predetermined period of time has been counted during the state where no printing data are received after the printing processing state has concluded.

7. An ink cartridge, comprising:

an ink tank having an ink injection port mounted on a surface thereof;

a cover which is in intimate contact with said ink tank, said cover having an opening portion that is positioned to allow said ink injection port to extend therethrough;

a protection cap slidably disposed between said cover and said ink tank for opening and closing said opening portion, said protection cap having a protrusion disposed on an end thereof; and a rubber piece disposed on an edge of said opening portion of said cover, wherein, when said protection cap is closed, said protrusion of said protection cap enters into said rubber piece to provide a substantially air-tight closure for said ink injection port.

8. The ink cartridge according to claim 7, further comprising a sponge disposed on an inner surface of said protection cap, wherein, when said protection cap is placed in a closed position from an open position, said sponge is pressed against said ink injection port to provide cleaning for said ink injection port.

9. The ink cartridge according to claim 8, wherein, when said protection cap is placed in the closed position, said sponge is in contact with said ink injection port.

10. The ink cartridge according to claim 8, wherein, when said protection cap is placed in the closed position, said sponge is not in contact with said ink injection port.

11. An ink jet recording apparatus, comprising:

an ink tank;

an ink injection port mounted on said ink tank for injecting ink;

a cover which is in intimate contact with said ink tank around said ink injection port and has an opening portion at a position corresponding to said ink injection port;

a protection cap held slidably between said cover and said ink tank for opening/closing said opening portion; and a retainer configured to hold said protection cap in an open state when said retainer is mounted to said cover, wherein when said protection cap is in a closed state, said ink injection port is provided with a substantially air-tight closure with respect to air external to said cover.

12. A retainer for an ink cartridge and a cover, the cover including a protection cap that can be positioned in a closed state to protect an ink injection port of the ink cartridge from outside air, or that can be positioned in an open state to allow for operation of the ink cartridge inside a printer, said retainer comprising:

a base configured to abut against a bottom surface of the cover;

a plurality of lower arms extending in a particular direction with respect to the base and configured to respectively slide into a plurality of grooves provided on a outer surface of the cover; and a protection cap retainer disposed between the plurality of lower arms, the protection cap retainer including a plurality of claws provided on the protection cap retainer and configured to position the protection cap into the open state when said plurality of lower arms are slid into the plurality of grooves of said cover.

13. The retainer according to claim 12, wherein said protection cap retainer is maintained coupled to said cover when said ink cartridge and cover are inserted into said printer.

14. The retainer according to claim 12, wherein, when said protection cap retainer is removed from said cover, said protection cap is positioned into the closed state.

15. The retainer according to claim 12, further comprising a plurality of upper arms extending in the particular direction with respect to the base and configured to support a back part of said cover when said plurality of lower arms are slid into the plurality of grooves of said cover.

* * * * *